US008944293B2

(12) United States Patent
Roth et al.

(10) Patent No.: US 8,944,293 B2
(45) Date of Patent: Feb. 3, 2015

(54) DISPENSER ADAPTED TO ENGAGE A BOTTLE AND ADAPTED FOR USE WITH THICK CONSUMABLE FLUID HAVING SOLID INGREDIENTS THEREIN

(71) Applicant: Cool Gear International LLC, Plymouth, MA (US)

(72) Inventors: Donna Roth, Duxbury, MA (US); Jason Meek, Bolton, CT (US)

(73) Assignee: Cool Gear International LLC, Plymouth, MA (US)

( * ) Notice: Subject to any disclaimer, the term of this patent is extended or adjusted under 35 U.S.C. 154(b) by 0 days.

(21) Appl. No.: 14/199,597

(22) Filed: Mar. 6, 2014

(65) Prior Publication Data

US 2014/0332564 A1 Nov. 13, 2014

Related U.S. Application Data

(60) Continuation of application No. 13/667,771, filed on Nov. 2, 2012, now abandoned, which is a division of application No. 12/484,481, filed on Jun. 15, 2009, now abandoned.

(51) Int. Cl.

| | |
|---|---|
| ***B67D 7/06*** | (2010.01) |
| ***B65D 47/20*** | (2006.01) |
| ***B65D 41/26*** | (2006.01) |
| ***B65D 47/32*** | (2006.01) |
| ***A47G 19/32*** | (2006.01) |

(52) U.S. Cl.

CPC ..... *B65D 47/2031* (2013.01); *B65D 41/26* (2013.01); *B65D 47/32* (2013.01); *A47G 19/32* (2013.01)

USPC ..... 222/205; 222/207; 222/212; 222/481.5

(58) Field of Classification Search

CPC ..... B65D 47/32; B65D 47/06

USPC ..... 222/367, 442, 481.5, 484, 536, 557, 222/212, 425, 548–555, 531, 205, 207

See application file for complete search history.

(56) References Cited

U.S. PATENT DOCUMENTS

| | | | | | |
|---|---|---|---|---|---|
| 1,556,911 | A | * | 10/1925 | Callender | 222/367 |
| 3,005,578 | A | * | 10/1961 | Mainicri | 222/450 |
| 3,347,420 | A | * | 10/1967 | Donoghue | 222/129 |
| 4,077,547 | A | * | 3/1978 | Donoghue | 222/207 |
| 4,106,673 | A | * | 8/1978 | Donoghue | 222/207 |
| 4,474,312 | A | * | 10/1984 | Donoghue | 222/205 |
| 4,971,226 | A | * | 11/1990 | Donoghue | 222/207 |
| 5,058,778 | A | * | 10/1991 | Weinstein | 222/209 |
| 5,104,606 | A | * | 4/1992 | Donoghue | 264/328.1 |
| 5,377,877 | A | * | 1/1995 | Brown et al. | 222/105 |
| 6,186,367 | B1 | * | 2/2001 | Harrold | 222/205 |
| 2003/0057235 | A1 | * | 3/2003 | Gueret | 222/182 |
| 2004/0011827 | A1 | * | 1/2004 | Lee | 222/522 |

* cited by examiner

*Primary Examiner* — Kevin P Shaver
*Assistant Examiner* — Robert Nichols, II
(74) *Attorney, Agent, or Firm* — Mintz Levin Cohn Ferris Glovsky and Popeo, P.C.; Steven M. Jensen

(57) ABSTRACT

A dispenser adapted for use with thick salad dressing or other consumable fluid which may have large solid ingredients therein.

4 Claims, 17 Drawing Sheets

DISPENSER ADAPTED TO ENGAGE A BOTTLE AND ADAPTED FOR USE WITH THICK CONSUMABLE FLUID HAVING SOLID INGREDIENTS THEREIN

CROSS-REFERENCE TO RELATED APPLICATIONS

This application is a continuation of application U.S. Ser. No. 13/667,771, filed on Nov. 2, 2012, which is a divisional of U.S. Ser. No. 12/484,481 filed on Jun. 15, 2009, the entire contents of which are incorporated herein by reference.

BACKGROUND

The present invention is generally directed to dispensers and, more specifically, to a dispenser adapted for use with thick consumable fluids that may include solid ingredients too large for use with conventional dispensers.

Typical dispensers are used to pour alcohol and other low viscosity fluids from bottles. However, thick fluids tend not to work with conventional dispensers as the fluid tends to clog portions of the dispenser mechanism. This problem is further exacerbated when the fluid has larger solid particles therein that tend to completely obstruct fluid flow through conventional dispensers.

It may be advantageous to provide a dispenser that is preferably adapted to be used with thicker fluids, that can preferably transfer fluids containing large solid particles; that is easy to use; and that preferably is ergonomically designed.

SUMMARY

Briefly speaking, one preferred embodiment of the present invention is directed to a dispenser adapted for use with thick salad dressing having solid ingredients therein. The dispenser includes a dispenser body defining a hopper adapted to hold a predetermined amount of salad dressing. A collar is engaged with the dispenser body and is adapted to secure the dispenser to a bottle. A membrane is located on the dispenser body and is positioned to be inside of the bottle when the collar is secured to the bottle. The membrane is adapted to allow flow therethrough from the bottle to the hopper, but not from the hopper to the bottle, of salad dressing having solid ingredients with a largest dimension of up to at least one quarter of an inch while allowing the solid ingredients to transport through the membrane and into the hopper. The dispenser is adapted to allow dispensing of the salad dressing in the predetermined amount from the hopper.

In a separate aspect, one embodiment of the present invention is directed to a dispenser adapted for use with thick salad dressing having solid ingredients therein. The dispenser including a dispenser body defining a hopper adapted to hold a predetermined amount of salad dressing. The hopper having a first hopper end adapted to be located distally from the bottle. The first hopper end having a generally oval shape. The dispenser flaring generally conically outwardly from the bottle to create at least a portion of a hand grip adapted to facilitate pouring salad dressing from the hopper. A collar is engaged with the dispenser body and adapted to secure the dispenser to a bottle. The collar has first and second collar ends. At least a portion of the hopper is located on the first collar end so that the at least a portion of the hopper is located outside of the bottle when the dispenser is attached thereto. The hopper further comprises a tube that extends through the collar and is adapted to be located within the bottle when the dispenser is attached thereto. The tube has an inner surface defining a channel. A membrane is located on the dispenser body and is positioned to be inside of the bottle when the collar is secured to the bottle. The membrane is adapted to allow flow therethrough from the bottle to the hopper, but not from the hopper to the bottle, of salad dressing having solid ingredients with a largest dimension of up to at least one quarter of an inch while allowing the solid ingredients to transport through the membrane and into the hopper. The membrane, when in a closed position, is generally convex such that an apex extends inside the hopper. The membrane has a generally circular shape formed by a plurality flaps joined together to form a circumference of the membrane. The dispenser is adapted to allow dispensing of the salad dressing including the solid ingredients in the predetermined amount from the hopper.

In another aspect, the present invention is directed to a dispenser adapted for use with thick consumable fluids having solid ingredients therein. The dispenser includes a dispenser body defining a hopper adapted to hold a predetermined amount of consumable fluid. The hopper has a first hopper end adapted to be located distally from the bottle. The first hopper end having a generally oval shape. A collar is engaged with the dispenser body and is adapted to secure the dispenser to a bottle. The collar has first and second collar ends. At least a portion of the hopper is located on the first collar end so that the at least a portion of the hopper is located outside of the bottle when the dispenser is attached thereto. The hopper further comprises a tube that extends through the collar and is adapted to be located within the bottle when the dispenser is attached thereto. The dispenser body flares generally conically outwardly from the bottle to create at least a portion of a hand grip adapted to facilitate pouring salad dressing from the hopper. The tube defines a channel along an inner surface. A membrane is located on the dispenser body and is positioned to be inside of the bottle when the collar is secured to the bottle. The membrane is adapted to allow flow therethrough from the bottle to the hopper, but not from the hopper to the bottle, of consumable fluid having solid ingredients with a largest dimension of up to at least one quarter of an inch while allowing the solid ingredients to transport through the membrane and into the hopper. The membrane, when in a closed position, is generally convex such that an apex extends inside the hopper. The membrane has first and second membrane sides. The first membrane side having a lip positioned along the perimeter. The membrane has a generally circular shape formed by a plurality flaps joined together to form a circumference of the membrane. A ring is positioned against the second membrane side to secure the membrane within the channel in the tube of the hopper of the dispenser body. The dispenser is adapted to allow dispensing of the consumable fluid including the solid ingredients in the predetermined amount from the hopper.

In another aspect, one embodiment of the present invention is directed to a dispenser adapted for use with thick salad dressing having solid ingredients therein. The dispenser includes a dispenser body defining a hopper adapted to hold a predetermined amount of salad dressing. The hopper defines a first hole therethrough. A collar is engaged with the dispenser body and is adapted to secure the dispenser to a bottle. The collar includes a sheath for receiving at least part of the hopper. The sheath defining a second hole therethrough. The hopper is moveable, relative to the collar, between a first hopper position, in which the first and second holes are not aligned and the salad dressing cannot pass between the bottle and the hopper, and a second hopper position, in which the first and second holes are aligned to allow salad dressing to pass between the bottle and the hopper. The dispenser is adapted to allow dispensing of the salad dressing including the solid ingredients in the predetermined amount from the hopper. The dispenser is preferably not suitable for preventing the passage of alcoholic beverages therethrough from the hopper back to the bottle when an attached bottle is shaken.

In a separate aspect, one embodiment of the present invention is directed to a dispenser adapted for use with consumable fluid which may have solid ingredients therein. The dispenser includes a dispenser body defining a hopper adapted to hold a predetermined amount of consumable fluid. A collar is engaged with the dispenser body and is adapted to secure the dispenser to a bottle. A membrane is located on the dispenser body and is positioned to be inside of the bottle when the collar is secured to the bottle. The membrane is adapted to allow flow therethrough from the bottle to the hopper, but not from the hopper to the bottle, of consumable fluid. The dispenser is adapted to allow dispensing of the consumable fluid in the predetermined amount from the hopper.

In another aspect, one embodiment of the present invention is directed to a dispenser adapted for use with consumable fluid. The dispenser includes a dispenser body defining a hopper adapted to hold a predetermined amount of consumable fluid. The hopper defines a first hole therethrough. A collar is engaged with the dispenser body and is adapted to secure the dispenser to a bottle. The collar includes a sheath for receiving at least part of the hopper. The sheath defining a second hole therethrough. The hopper is moveable, relative to the collar, between a first hopper position, in which the first and second holes are not aligned and the consumable fluid cannot pass between the bottle and the hopper, and a second hopper position, in which the first and second holes are aligned to allow consumable fluid to pass between the bottle and the hopper. The dispenser is adapted to allow dispensing of consumable fluid in the predetermined amount from the hopper.

BRIEF DESCRIPTION OF THE SEVERAL VIEWS OF THE DRAWINGS

The foregoing summary, as well as the following detailed description of the preferred embodiments of the present invention will be better understood when read in conjunction with the appended drawings. For purposes of illustrating the invention, there are shown in the drawings, embodiments which are presently preferred. It is understood, however, that the invention is not limited to the precise arrangements and instrumentalities shown. In the drawings:

FIG. 1 is a perspective view of a dispenser according to a preferred embodiment of the present invention; The dispenser includes a dispenser body that defines a hopper which preferably flares generally outwardly from the top of the bottle; The dispenser body is adapted to be preferably secured to the bottle via a collar; A lid may be attached to the top of the hopper via a snap fit connection of the like;

DETAILED DESCRIPTION OF THE PREFERRED EMBODIMENT

Figure 1:
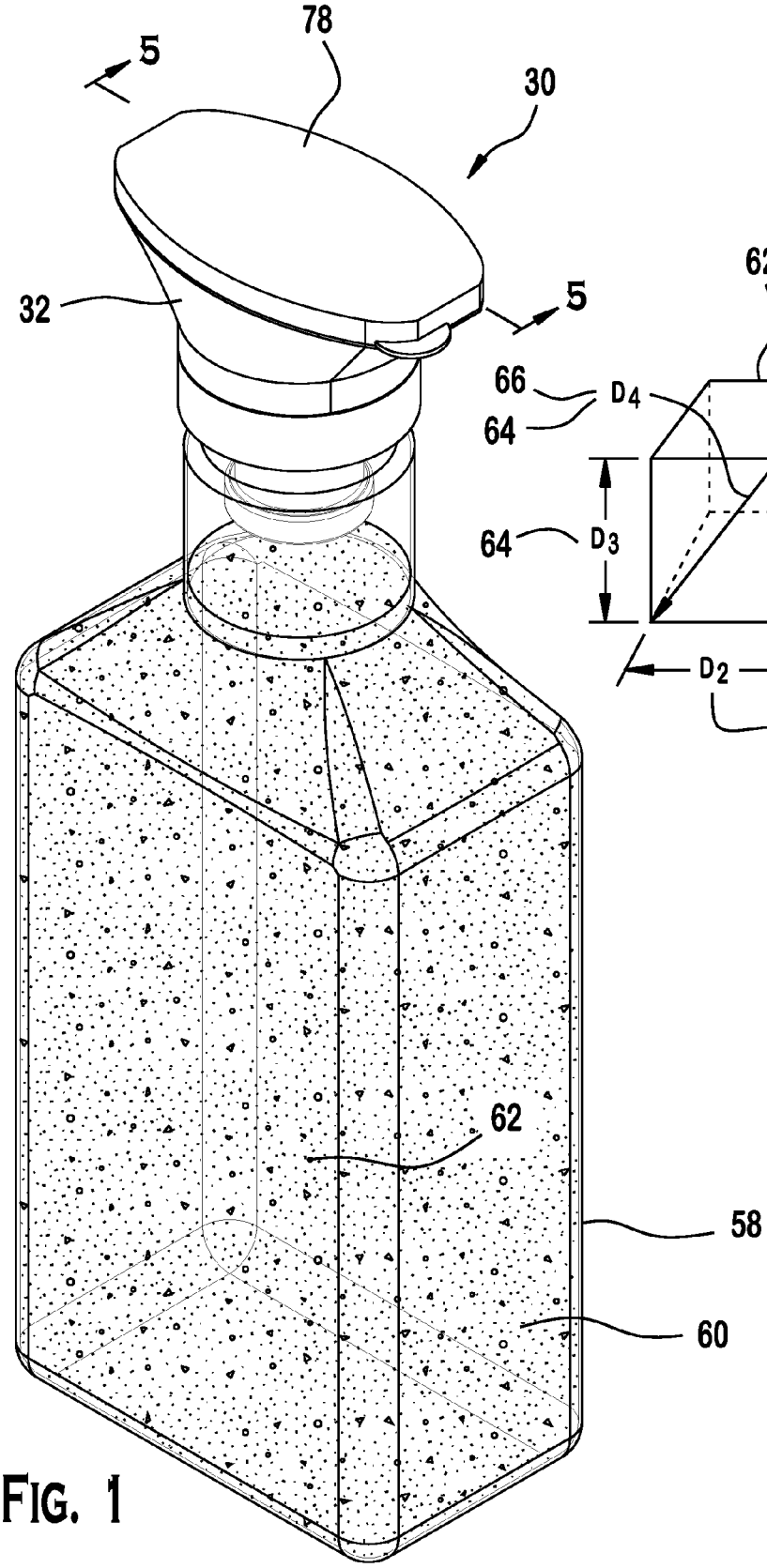

Certain terminology is used in the following description for convenience only and is not limiting. The words "right,"

"left," "upper," and "lower" designate directions in the drawings to which reference is made. The words "inwardly" and "outwardly" refer to directions toward and away from, respectively, the geometric center of the system for use with a consumable beverage and designated parts thereof. The term "consumable fluid", as used in the claims and the relevant portions means, "any fluid suited for consumption such as yogurt, salad dressing, jam, toppings, etc." It is understood that when used in the "Detailed Description of the Preferred Embodiment" section, the term "salad dressing" means "salad dressing or other consumable fluid". The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-23, wherein like numerals indicate like elements throughout, preferred embodiments of a dispenser are shown and generally designated as 30. Briefly stated, the dispenser of the present invention is preferably adapted for use with thicker consumable fluids having large solid ingredients, such as salad dressings.

While the drawings show threaded or snap fit connections, those of ordinary skill in the art will appreciate from this disclosure that any other known suitable connection mechanism, such as a fastener, friction fit, snap fit, or the like can be used with any of the connections in the dispenser 30 without departing from the scope of the present invention. Alternatively, the dispenser body 32 and the collar 80 can be a single integral component. Additionally, the dispenser 30 can be used with one of multiple interchangeable hoppers 34 if so desired.

The dispenser 30 and its component parts are preferably formed from a sturdy, non-reactive, durable, food grade material, such as a suitable polymer. However, those of ordinary skill in the art will appreciate from this disclosure that the dispenser 30 and its various components can be formed from any materials suitable for use with consumable fluids.

Figure 3:
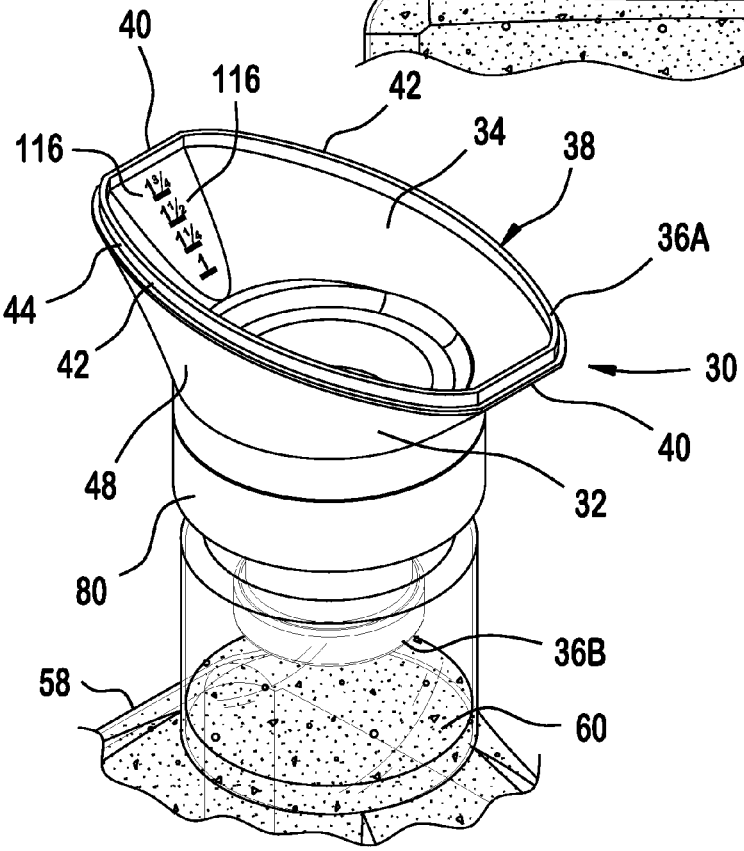
FIG. 3 is a perspective view of the dispenser of FIG. 1 with the lid removed; the inner surface of the hopper preferably includes markings to allow one of multiple different predetermined amounts of consumable fluid to be dispensed from the hopper; The top of the hopper preferably has a generally oval shape which may be formed by two short strait segments connected by two arcuate segments; those of ordinary skill in the art will appreciate from this disclosure that the mouth of the hopper can have any shape without departing from the scope of the present invention.
Figure 4:
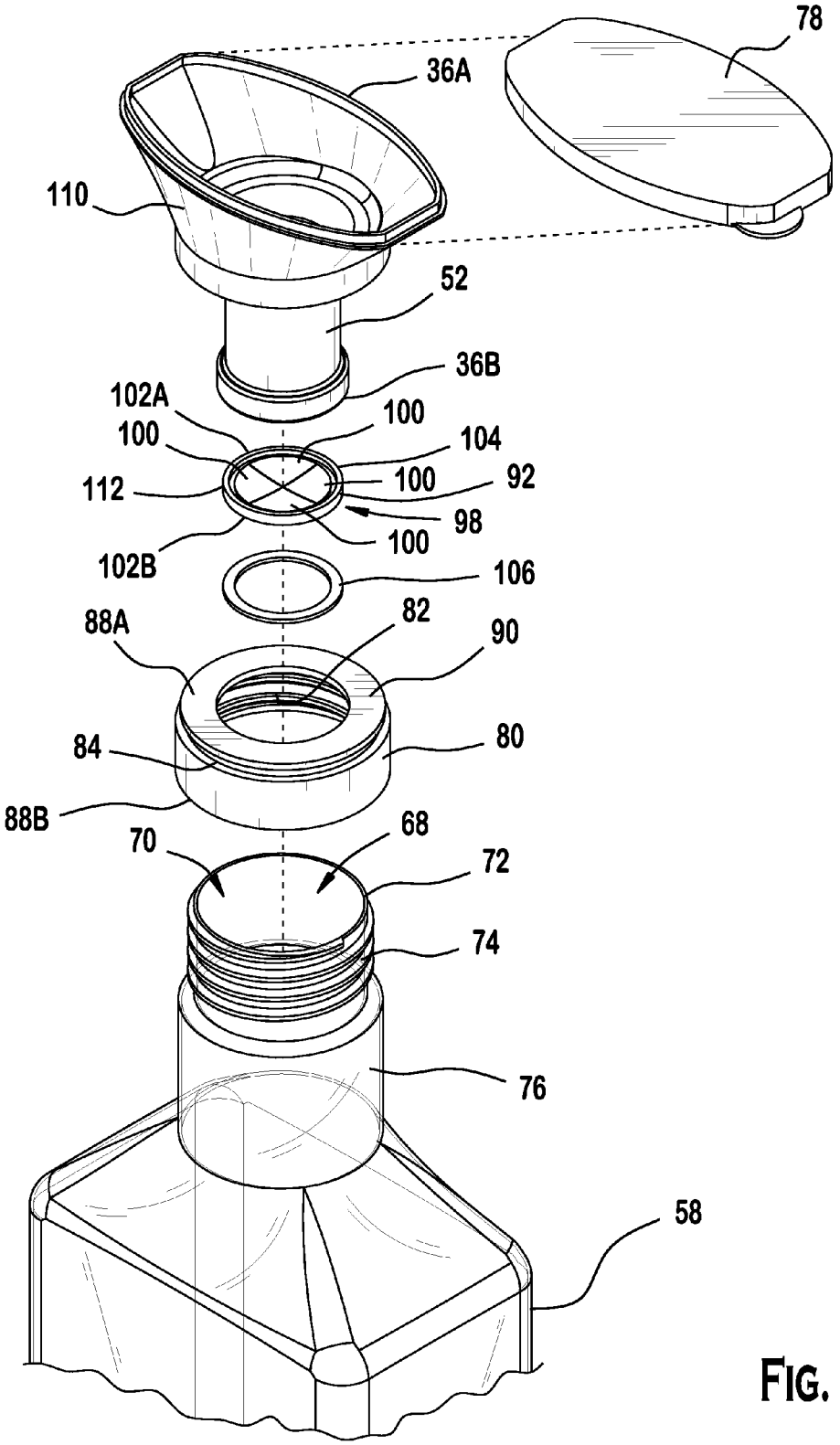
FIG. 4 is an exploded view of the dispenser of FIG. 1; The tube of the hopper preferably defines a channel which receives the membrane; The membrane can be secured in position by a ring; Alternatively, the membrane may be located on the dispenser body and positioned to be inside of the bottle when the collar is secured to the bottle; The membrane can be adapted to allow flow therethrough from the bottle to the hopper, but not from the hopper to the bottle, of consumable fluid having solid ingredients with a largest dimension of up to anywhere from one sixty fourth of an inch to one inch while allowing the solid ingredients to transport through the membrane and into the hopper; those of ordinary skill in the art will appreciate from this disclosure that the membrane can be configured to operate with solid ingredients of any size without departing from the scope of the present invention; the membrane, when in a closed position, is preferably generally convex such that an apex extends inside the hopper; The membrane can have first and second membrane sides; The first membrane side may have a lip positioned along the perimeter; The membrane may have a generally circular shape formed by a plurality flaps joined together to form a circumference of the membrane.

Referring to FIGS. 1 and 4, a dispenser 30 is preferably adapted for use with thick salad dressing (or other consumable fluids) 60 having solid ingredients therein. Referring to FIG. 3, a dispenser body 32 can define a hopper 34 adapted to hold a predetermined amount of salad dressing 60. A plurality of markings 116 may be located on the hopper 34. The markings are preferably adapted to allow one of a plurality of different predetermined amounts of salad dressing 60 to be secured in the hopper 34. It is preferred that the hopper hold a maximum of two tablespoons. However, those of ordinary skill in the art will appreciate from this disclosure that the hopper can be sized to hold any amount(s) of consumable fluid without departing from the scope of the present invention.

Referring to FIGS. 1 and 3, a lid 78 may be engaged over the dispenser hopper 34. The lid is preferably secured to a shoulder 44 formed proximate to the top of the dispenser body 32.

Figure 7:
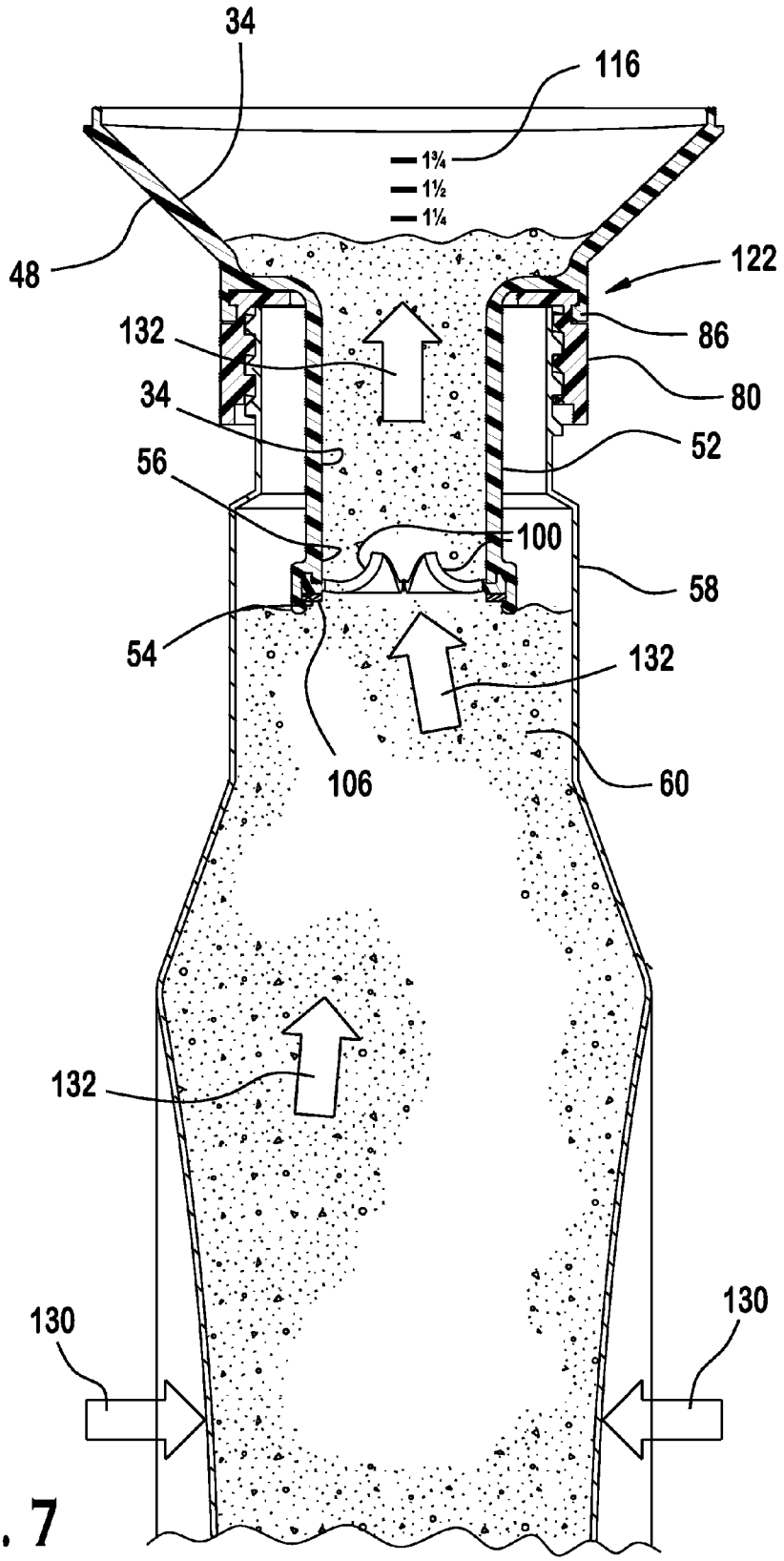
FIG. 7 is a radial cross-sectional view of the dispenser of FIG. 1 illustrating the flow of consumable fluid from the bottle into the hopper; Lateral arrows show force resulting from a squeeze action on the bottle and the generally vertical arrows show the flow of consumable fluid; The flaps of the membrane are shown in the open position which allows consumable fluid and any entrained solid ingredients to move into the hopper.

Referring to FIG. 7, it is preferred, but not necessary, that at least some 120 of the dispenser body 32 is at least one of translucent and transparent. The at least some 120 of the dispenser body 32 may be adapted to facilitate comparing an amount of salad dressing 60 in the hopper with the plurality of markings 116.

Referring to FIGS. 3 and 4, the top of the hopper 34 preferably has a generally oval shape 38. The oval shape can be formed by short straight segments 40 of the upper hopper edge connected by two arcuate segments 42 of the upper hopper edge. those of ordinary skill in the art will appreciate from this disclosure that the mouth of the hopper 34 can have any shape without departing from the scope of the present invention.

Figure 2:
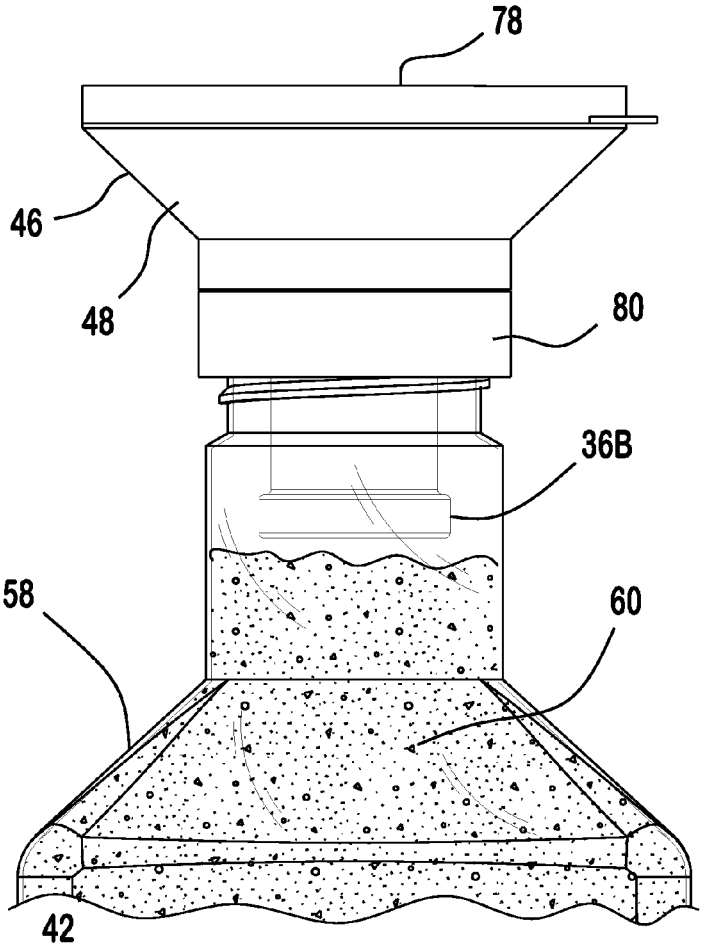
FIG. 2 is an enlarged front elevational view of the dispenser of FIG. 1 illustrating the hopper being configured to include a tube that preferably extends into the bottle.
Figure 5:
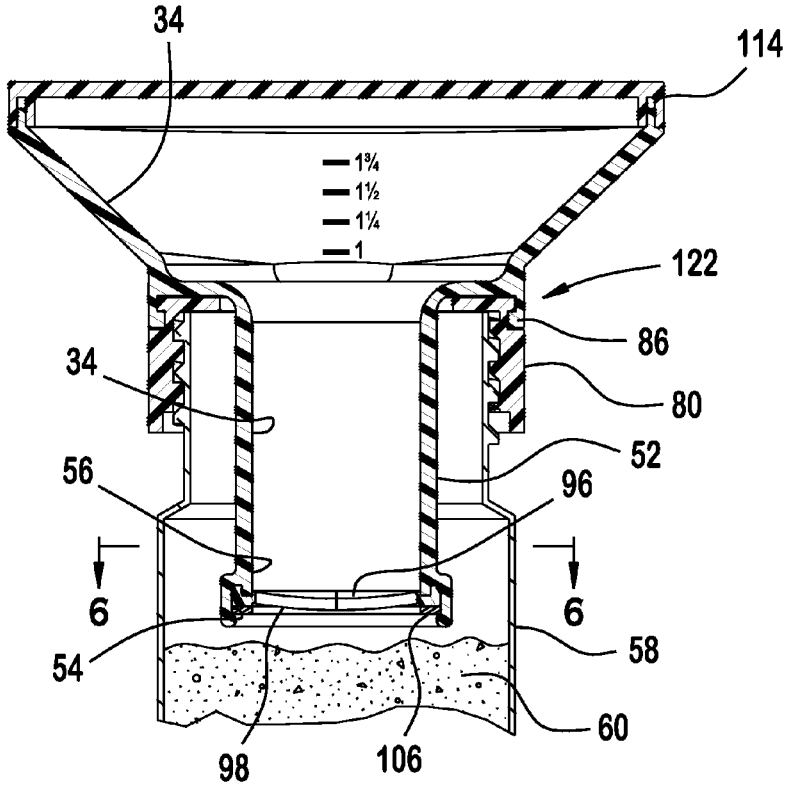
FIG. 5 is a cross-sectional view of a the dispenser of FIG. 1 as taken along the line 5-5 of FIG. 1 illustrating the membrane forming a concave bend when viewed from the inside of the hopper; The dispenser bottle is preferably secured to the collar by a rotatable connection formed by the engagement of a dispenser body circumferential lip with a collar groove; bottle of the present invention.

Referring to FIGS. 2 and 5, a collar 80 may be engaged with the dispenser body 32 and can be adapted to secure the dispenser 30 to a bottle 58. The collar 80 preferably has first and second collar ends 88A, 88B. At least a portion of the hopper 34 can be located on the first collar end 88A so that the at least a portion of the hopper 34 is located outside of the bottle 58 when the dispenser 30 is attached thereto. The hopper may further comprise a tube 52 that extends through the collar 80 and is adapted to be located within the bottle 58 when the dispenser 30 is attached thereto. The dispenser body 32 can be rotatably connected to the collar 80 and can be adapted to be rotatable while the collar 80 is secured to the bottle 58. It is preferred that the collar tube 52 is inserted through an annular ring section 90 of the collar 80.

Referring to FIGS. 4 and 5 the dispenser body may have a circumferential lip 86 that extends downwardly from below the outwardly flared section 48 of the dispenser. the circumferential lip 86 may engage a groove 84 in the upper portion of the collar 80.

Figure 6:
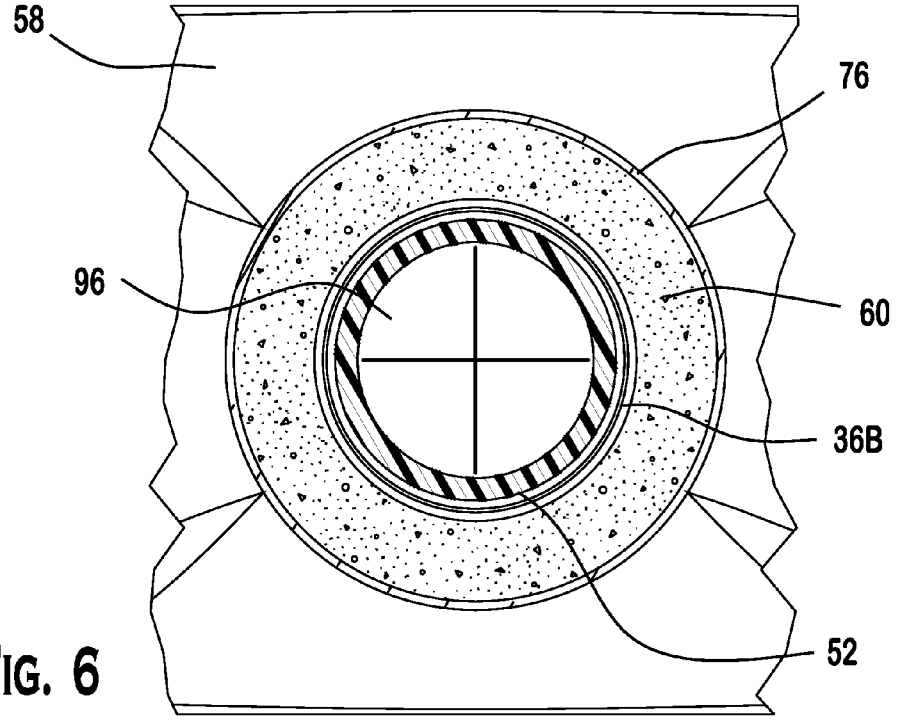
FIG. 6 is a cross-sectional view of the dispenser of FIG. 1 as taken along the line 6-6 in FIG. 5 illustrating the membrane in the closed position.
Figure 8:
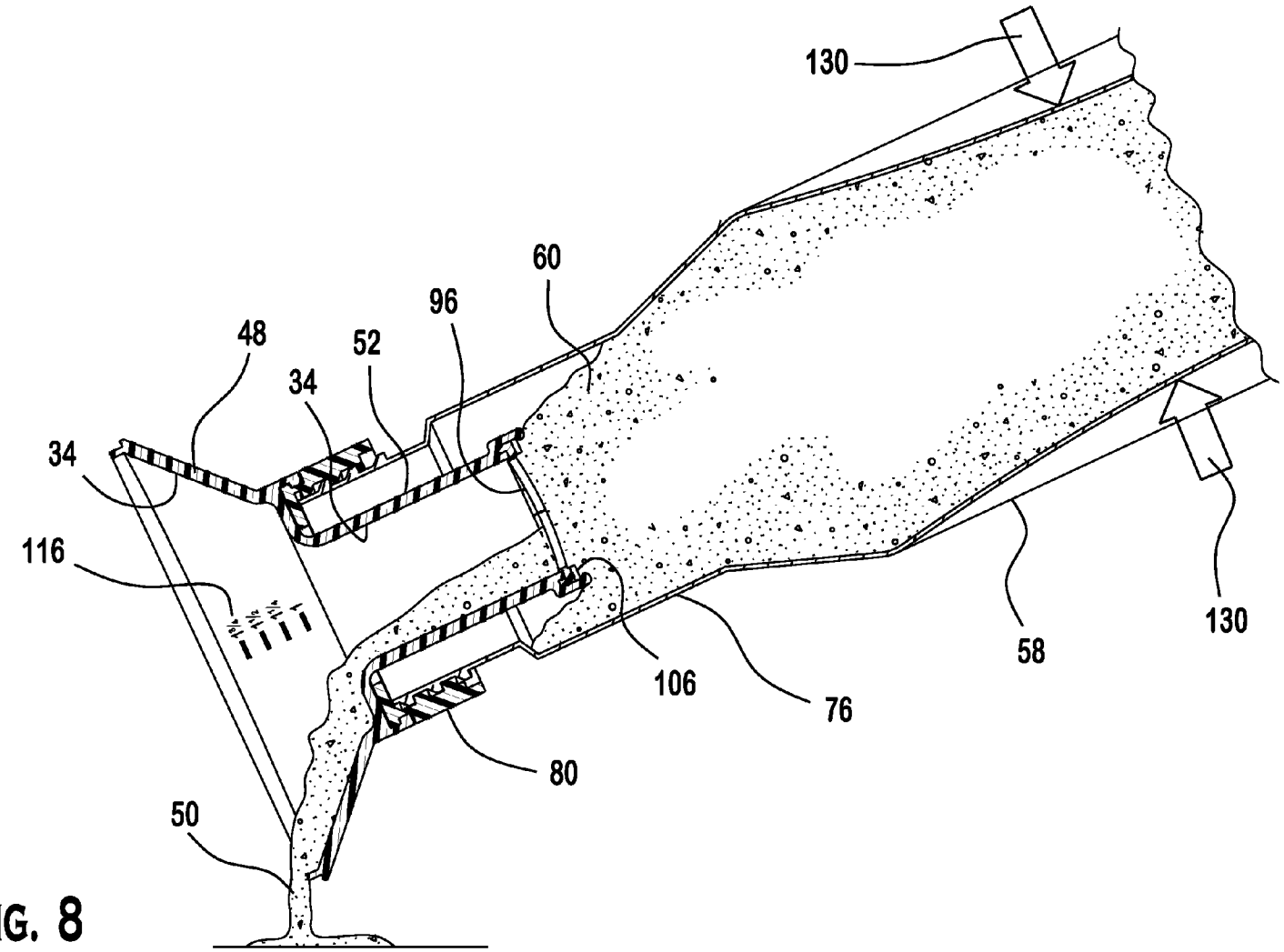
FIG. 8 is a view similar to FIG. 7 illustrating that in one embodiment, the bottle may be maintained in a partially squeezed configuration after the membrane has closed and then tilted to pour out the contents from the hopper.

Referring to FIGS. 4 and 6, a membrane 92 may be located on the dispenser body 32 and positioned to be inside of the bottle 58 when the collar 80 is secured to the bottle 58. Referring to FIG. 8 the connection between the collar 80 and the bottle 58 is preferably threaded. Referring to FIG. 4, at least one thread 74 on the bottle is preferably configured to engage at least one collar thread 82. It is preferred that when the collar 80 is engaged with the bottle 58, that the collar 80 is positioned over the upper edge 72 of the bottle mouth 68 with a portion of the hopper 34 possibly extending into the neck 76 of the bottle 58.

Referring to FIGS. 4, 6, and 7, a membrane 92 is preferably adapted to allow flow therethrough from inside 70 the 58 bottle to the hopper 34, but not from the hopper 34 to the bottle 58, of salad dressing 60 (or other consumable fluid) having solid ingredients 62 with a largest dimension 66 of up to at least one inch. It is preferred that the largest dimension 66 be anywhere from one sixty fourth of an inch and one inch. However, those of ordinary skill in the art will appreciate from this disclosure that the dispenser can be configured to accommodate solid ingredients 62 of any size without departing from the scope of the present invention.

Figure 1A:
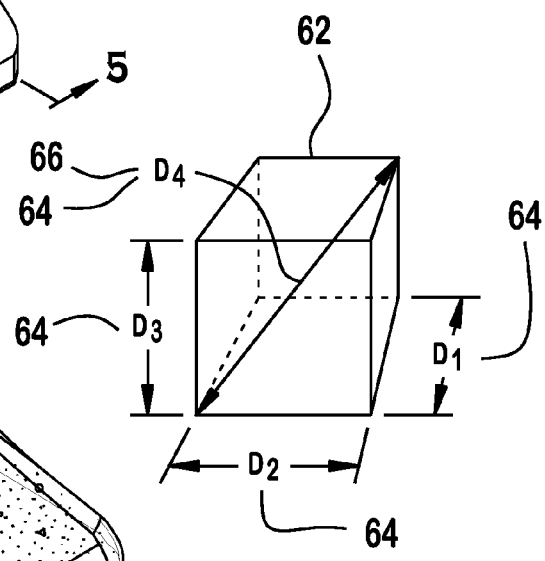
FIG. 1A is a schematic showing an exemplary solid ingredient which may be transported from a bottle, into the hopper of the dispenser, and later dispensed as part of a predetermined amount of consumable fluid; Various dimensions of the solid ingredient are shown as well as the largest dimension; While one exemplary shape is shown, those of ordinary skill in the art will appreciate from this disclosure that the solid ingredient can have any shape and/or configuration without departing from the scope of the present invention.

Referring to FIG. 1A, one exemplary solid ingredient is shown having multiple dimensions 64 and one largest dimension 66. While one preferred shape is shown, any shape or configuration of solid ingredient 62 can be used with the dispenser 30 of the present invention without departing from the scope of the present invention.

It is preferred that the membrane 92 is adapted to allow flow therethrough from inside 70 the 58 bottle to the hopper 34, but not from the hopper 34 to the bottle 58, of salad dressing 60 (or other consumable fluid) having solid ingredients 62 with a largest dimension 66 of up to one quarter of an inch while allowing the solid ingredients 62 to transport through the membrane 92 and into the hopper 34. Alternatively, the membrane 92 may be configured to accommodate solid ingredients 62 having a largest dimension 66 of up to three eighths of an inch. In another embodiment, the membrane 92 may be configured to accommodate solid ingredients 62 having a largest dimension 66 of up to half an inch.

Alternatively still, the membrane 92 may be configured to accommodate solid ingredients 62 having a largest dimension 66 of up to three quarters of an inch.

Figure 11:
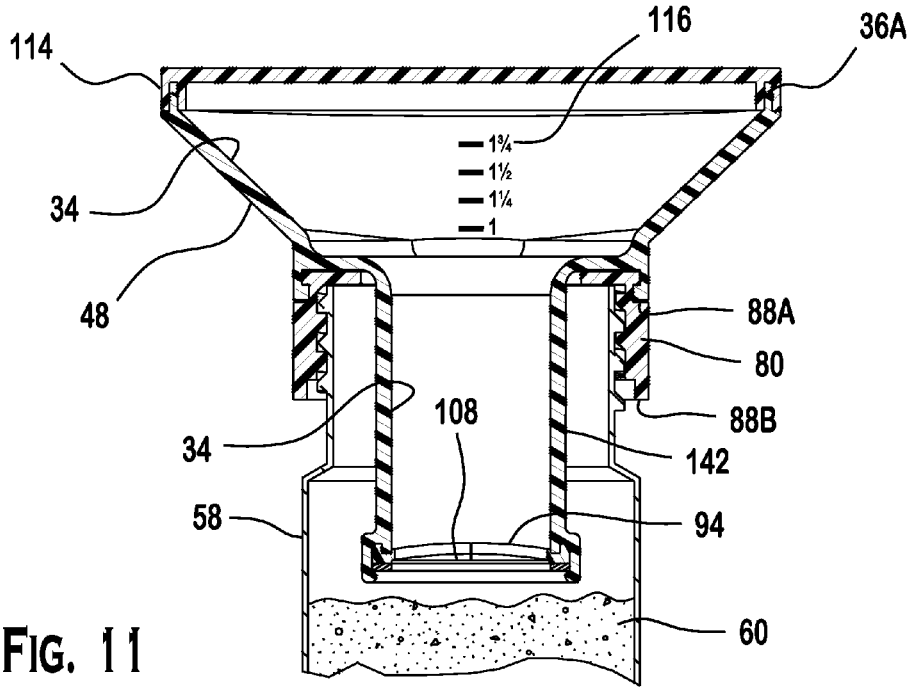
FIG. 11 is a front elevational view of one embodiment of the dispenser showing the membrane having a convex shape, as viewed from the hopper, when in the closed position; The membrane may have first and second membrane sides, the first membrane side can have a lip positioned along the perimeter; A ring may be positioned against the second membrane side to secure the membrane within a channel in the tube of the hopper of the dispenser body; those of ordinary skill in the art will appreciate from this disclosure that the membrane can have any shape, curvature, or lack curvature when viewed in a fashion similar to that shown in FIG. 11 without departing from the scope of the present invention.
Figure 14:
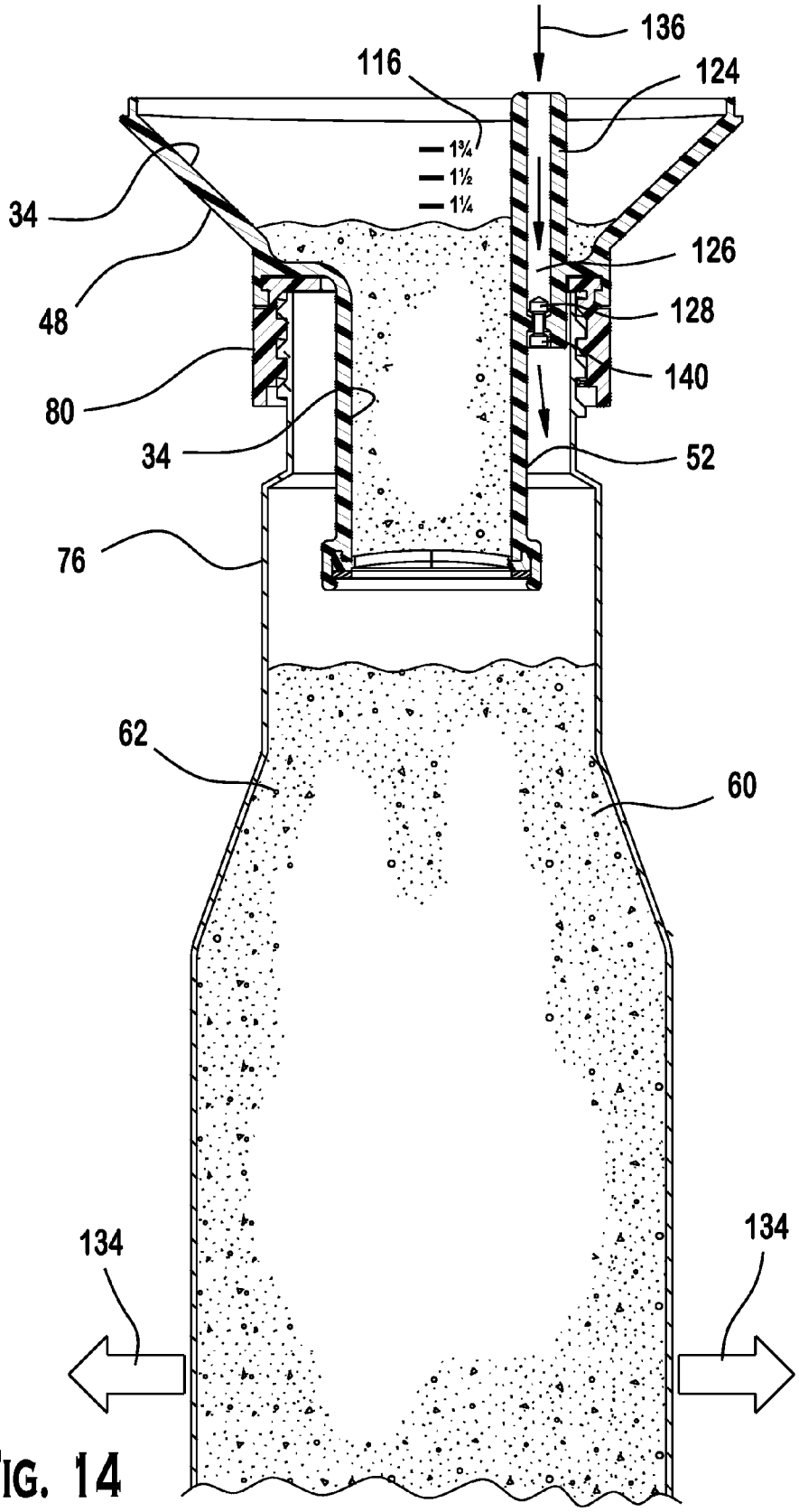
FIG. 14 is front elevational view of a dispenser similar to that of FIG. 13 with a vent preferably between the hopper and an exterior of the bottle to establish a fluid passageway therebetween separate from the membrane that is adapted to allow air to enter the bottle after salad dressing (or other consumable fluid) has been driven from the bottle, through the membrane, and into the hopper; Lateral arrows show force resulting from an expansion action on the bottle and the downwardly pointed vertical arrows show the flow of air into the bottle via the vent to help prevent backflow of consumable fluid into the bottle from the hopper; The flaps of the membrane are shown in the closed position to secure consumable fluid and any entrained solid ingredients in the hopper; During the expansion action, the intake of air is possible due to the check valve being in an open configuration.
Figure 15:
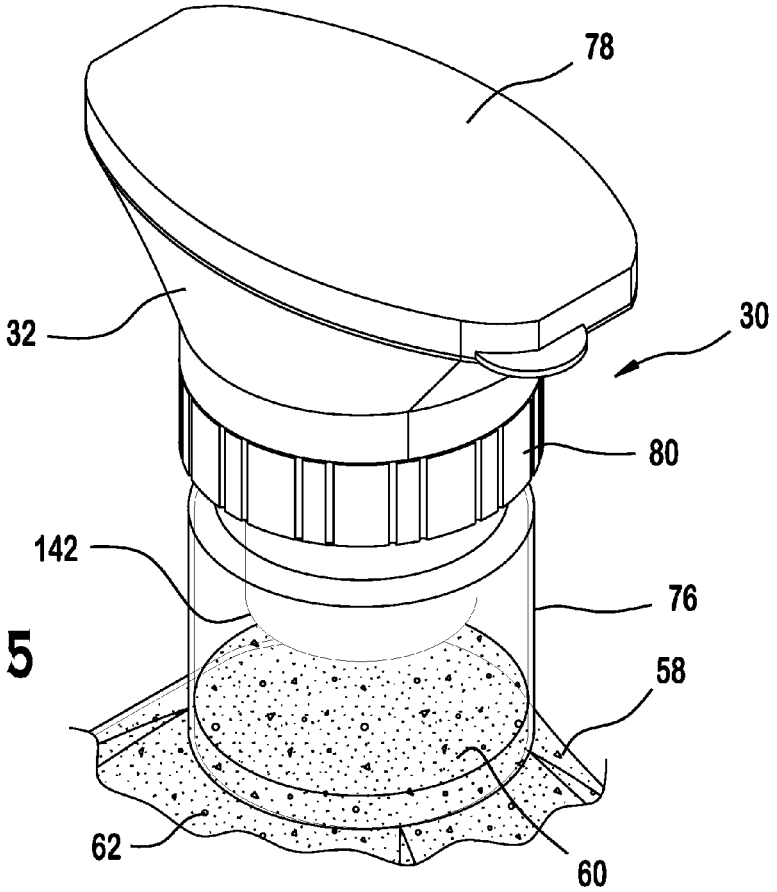
FIG. 15 is a perspective view of another preferred embodiment of the dispenser of the present invention; Protruding into the neck of the bottle is preferably a sheath that is part of the collar; The sheath is adapted to receive a part of the dispenser body therein.

Referring to FIGS. 11 and 14, the membrane 92, when in a closed position (shown in FIGS. 11, 12, and 14), is generally convex 94 such that an apex 108 extends inside the hopper 34. The membrane 92 is adapted to allow solid ingredients 62 entrained in salad dressing 60 to pass therethrough and into the hopper 34. Referring to FIG. 4, the membrane 92 preferably has a generally circular shape 98 formed by a plurality flaps 100 joined together to form a circumference 112 of the membrane 92.

Referring to FIGS. 3 and 4, the hopper 34 can have a first hopper end 36A adapted to be located distally 114 from the bottle 58. The first hopper end 36A may have a generally oval shape 38. The dispenser 30 preferably flaring generally conically outwardly 48 from the bottle 58 to create at least a portion of a hand grip 46 adapted to facilitate pouring 58 salad dressing (shown in FIG. 8) from the hopper 34. It is preferred that the outward flare 48 allows a user to place a portion of the conical section between a thumb and adjacent finger to rest on a side of the hand opposite from the palm. This significantly simplifies pouring in an ergonomic fashion. while a preferred configuration for the portion of the handle 46 is shown, those of ordinary skill in the art will appreciate from this disclosure that the handle portion 46 can have any shape without departing from the scope of the present invention.

Figure 13:
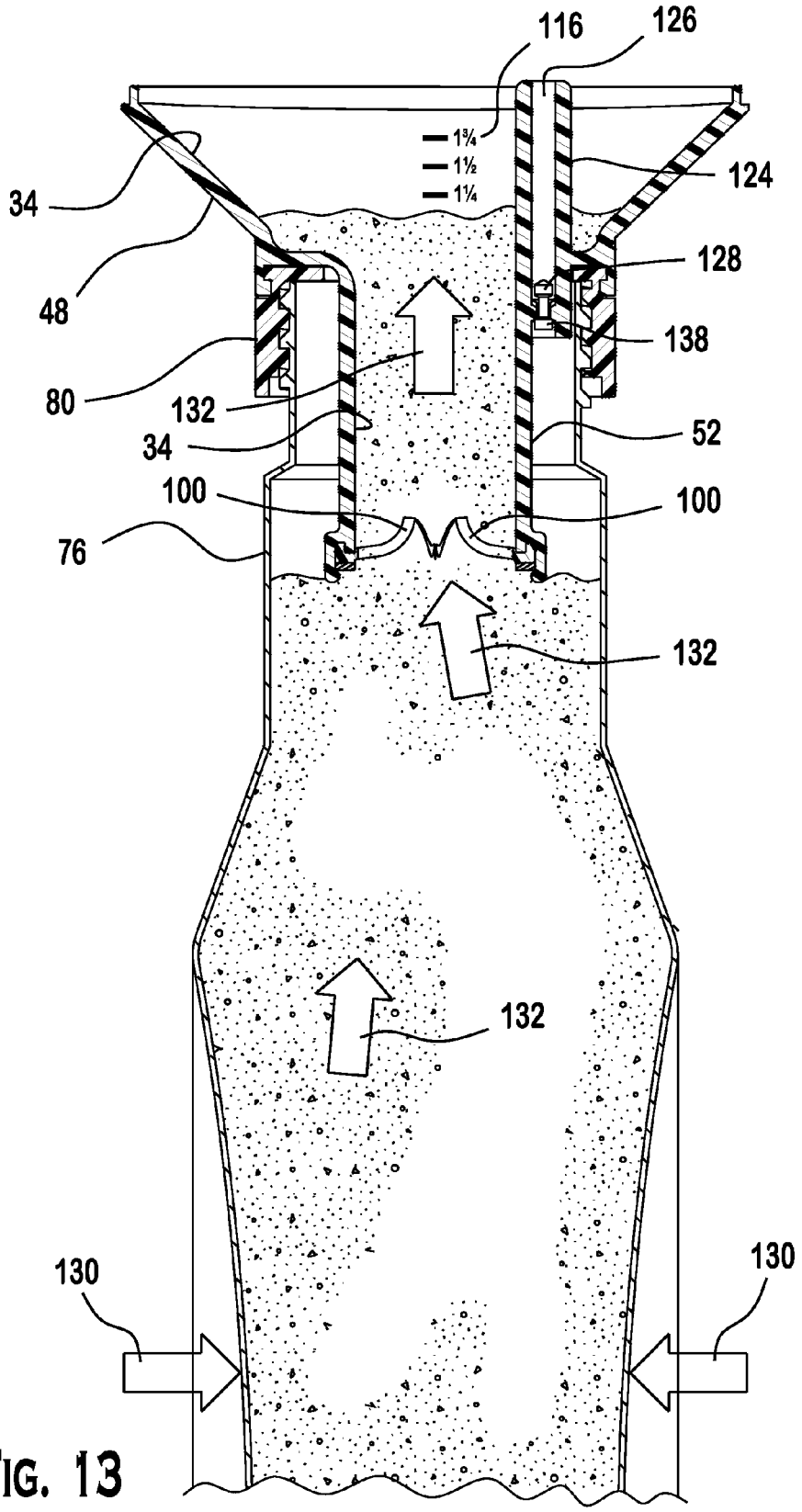
FIG. 13 is front elevational view of a dispenser similar to that of FIG. 7 with a vent preferably between the hopper and an exterior of the bottle to establish a fluid passageway therebetween separate from the membrane that is adapted to allow air to enter the bottle after salad dressing (or other consumable fluid) has been driven from the bottle, through the membrane, and into the hopper; The fluid passageway may extend from the bottle, through the dispenser body, and to the exterior of the both the dispenser and the bottle; The vent may include a check valve to allow air flow into the bottle only; While multiple vent configurations are disclosed in this application, those of ordinary skill in the art will appreciate from this disclosure that that any type of vent can be used with the dispenser and/or dispenser and bottle of the present invention without departing from the scope of the present invention; Lateral arrows show force resulting from a squeeze action on the bottle and the generally vertical arrows show the flow of consumable fluid; The flaps of the membrane are shown in the open position which allows consumable fluid and any entrained solid ingredients to move into the hopper; During the expelling of consumable fluid from the bottle the check valve is positioned in a closed position that prevents airflow therethrough.

Referring to FIGS. 7 and 13, the membrane 19 may be adapted to allow solid ingredients 62 entrained in salad dressing 60 to pass therethrough and into the hopper 34. At least one embodiment of the membrane 92 is preferably not suitable for preventing the passage of alcoholic beverages therethrough from the hopper 34 back to the bottle 58. This can result in alcohol flowing back through the membrane 92 into the bottle 58 when the liquid is allowed to stand or when the dispenser and/or bottle are moved.

Figure 9:
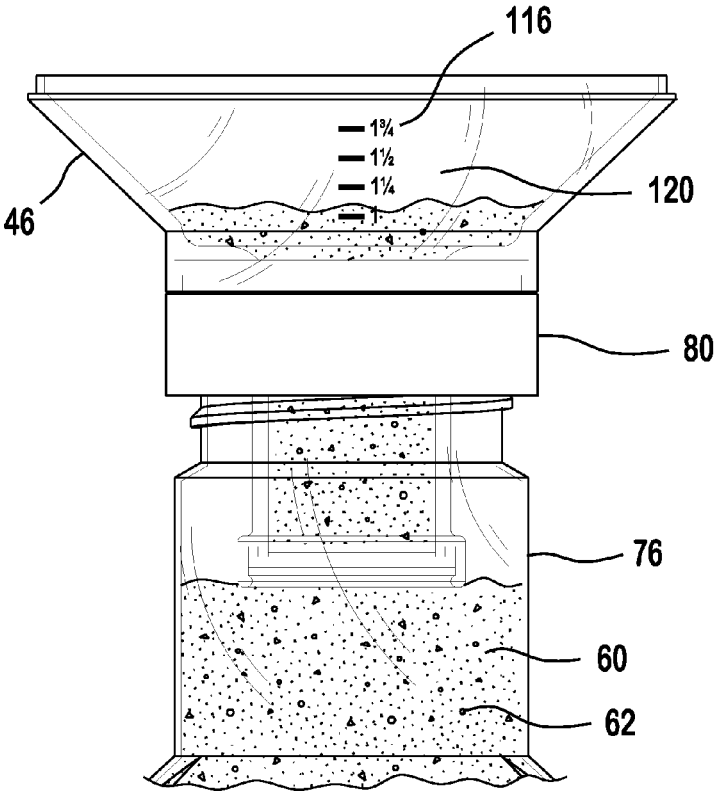
FIG. 9 is a front elevational view of the hopper according to another preferred embodiment illustrating that at least some of the dispenser body is at least one of translucent and transparent, the at least some of the dispenser body being adapted to facilitate comparing an amount of salad dressing in the hopper with the plurality of markings.
Figure 10:
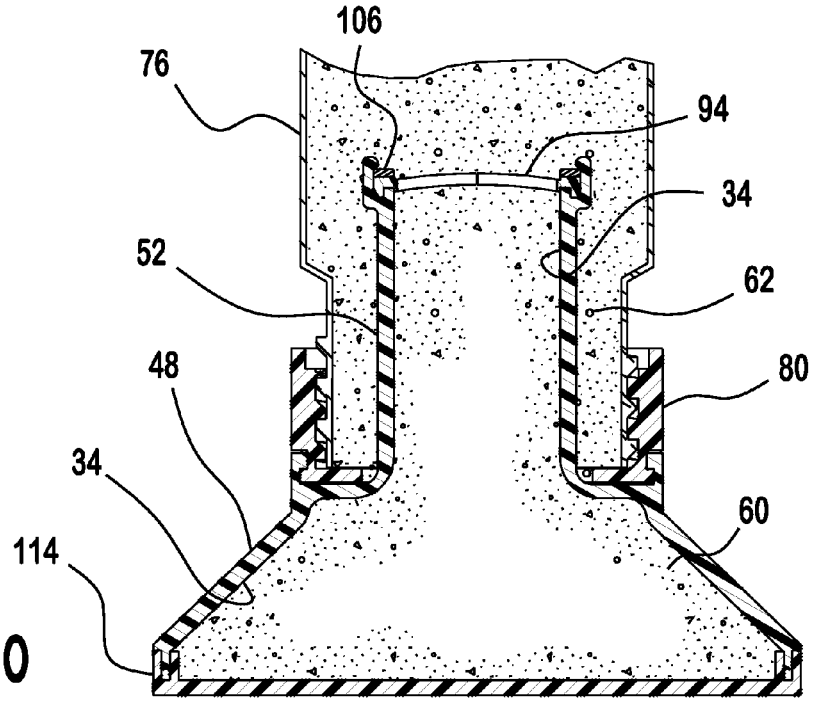
FIG. 10 is an upside down view of one embodiment of the dispenser showing the membrane having a concave shape, as viewed from the hopper, when in the closed position; The membrane can have first and second membrane sides; The first membrane side may have a lip positioned along the perimeter; A ring can be positioned against the second membrane side to secure the membrane within a channel in the tube of the hopper of the dispenser body.
Figure 12:
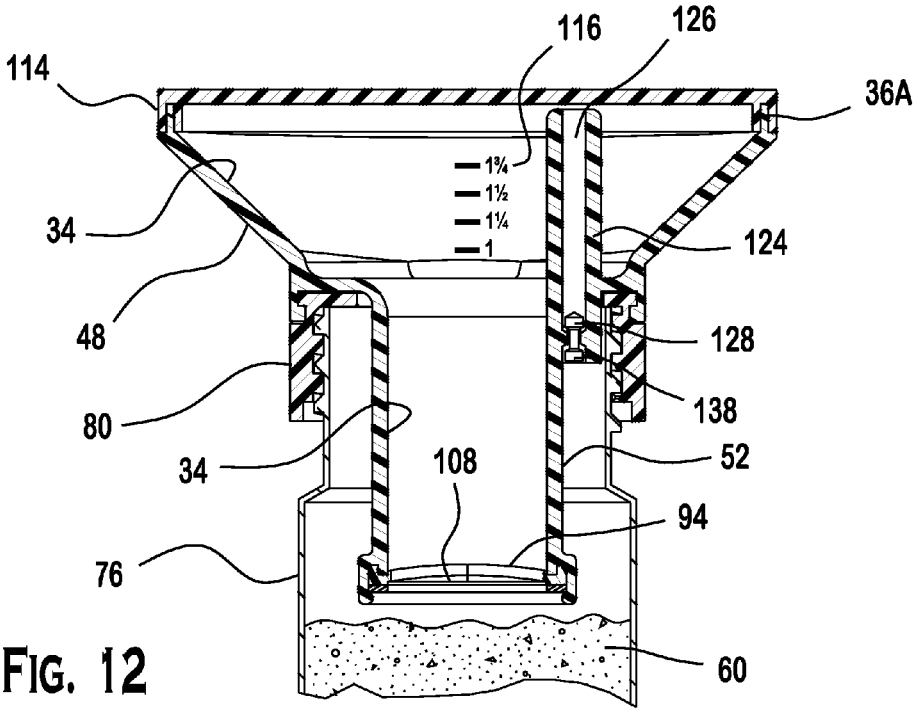
FIG. 12 is front elevational view of a dispenser similar to that of FIG. 11 with a vent preferably between the hopper and an interior of the bottle to establish a fluid passageway therebetween separate from the membrane that may be adapted to allow air to enter the bottle after salad dressing has been driven from the bottle, through the membrane, and into the hopper; The vent may include a check valve to allow air flow into the bottle only.

Referring to FIGS. 4 and 12, the membrane 92 preferably has first and second membrane sides 102A, 102B. The first membrane side 102A may have a lip 104 positioned along the perimeter. A ring 106 can be positioned against the second membrane side 102B to secure the membrane 92 within a channel 54 defined by an inner surface 56 of the tube 52 of the hopper 34 of the dispenser body 32. The dispenser 30 is preferably adapted to allow dispensing of the salad dressing 60 including large solid ingredients in the predetermined amount from the hopper. Referring to FIG. 10, the dispenser may include a membrane 92 having a generally concave shape 96, as viewed from the hopper, when in the closed position. Referring to FIG. 9, the hopper 34 may have at least some 120 of the dispenser body 32 formed by at least one of translucent and transparent material.

Referring to FIGS. 13 and 14, a vent 124 may be located between the hopper 34 and an interior 70 of the bottle 58 to establish a fluid passageway 126 therebetween separate from the membrane 92 that is adapted to allow air to enter the bottle after salad dressing 60 has been driven from the bottle 58, through the membrane 92, and into the hopper 34. The vent 124 may include a check valve 128. Alternatively, the vent 124 may be located between the bottle 58 and an exterior of the bottle to establish a fluid passageway 126 therebetween separate from the membrane 92.

Referring specifically to FIG. 13, the vent 124 is preferably between the hopper 34 and an exterior of the bottle to establish a fluid passageway 126 therebetween separate from the membrane that is adapted to allow air to enter the bottle after salad dressing 60 (or other consumable fluid) has been driven from the bottle. While multiple vent configurations are disclosed in this application, those of ordinary skill in the art will appreciate from this disclosure that that any type of vent can be used with the dispenser and/or dispenser and bottle of the present invention without departing from the scope of the present invention. Lateral arrows 130 show force resulting from a squeeze action on the bottle and the generally vertical arrows 132 show the flow of consumable fluid 60. The flaps 100 of the membrane 92 are shown in the open position which preferably allows consumable fluid 60 and any entrained solid ingredients 62 to move into the hopper 34. During the expelling of consumable fluid 60 from the bottle 58 the check valve 128 is positioned in a closed position 138 that prevents airflow therethrough.

Referring specifically to FIG. 14, a vent 124 may extend from the bottle through the hopper to exterior of the bottle and dispenser to establish a fluid passageway 126 therebetween separate from the membrane 92 that is adapted to allow air to enter the bottle after salad dressing (or other consumable fluid) 60 has been driven from the bottle. Lateral arrows 134 show force resulting from an expansion action on the bottle and the downwardly pointed vertical arrows 136 show the flow of air into the bottle via the vent 124 to help prevent backflow of consumable fluid 60 into the bottle 58 from the hopper 34. The flaps 100 of the membrane 92 are shown in the closed position to secure consumable fluid 60 and any entrained solid ingredients 62 in the hopper 34. During the expansion action, the intake of air is possible due to the check valve 128 being in an open configuration 140.

Referring to FIGS. 15-23, anther embodiment of the dispenser 30 is shown and adapted for use with thick salad dressing (or consumable fluid) 60 which may have solid ingredients 62 therein. The dispenser body 30 can define a hopper 34 adapted to hold a predetermined amount of salad dressing 60. The hopper preferably defines a first hole 144 therethrough.

Figure 17:
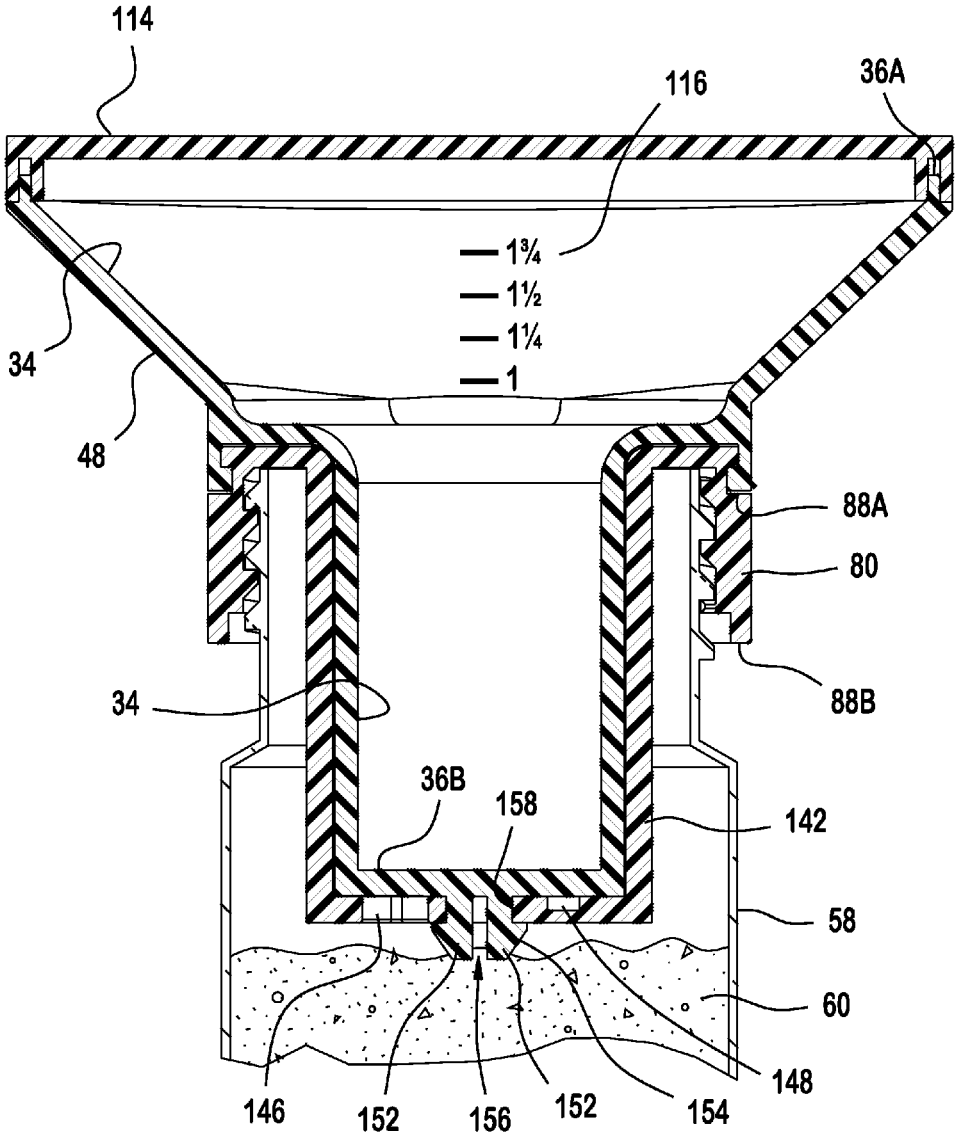
FIG. 17 is a cross-sectional view of the dispenser of FIG. 15 illustrating a collar engaged with the dispenser body and adapted to secure the dispenser to a bottle; The collar may include a sheath for receiving at least part of the hopper; The sheath can define a second hole therethrough; The hopper is preferably moveable, relative to the collar, between a first hopper position (shown in FIG. 17), in which the first and second holes are not aligned and the salad dressing cannot pass between the bottle and the hopper, and a second hopper position (shown in FIGS. 20 and 22), in which the first and second holes are aligned to allow salad dressing to pass between the bottle and the hopper; The dispenser is adapted to allow dispensing of the salad dressing including the solid ingredients in the predetermined amount from the hopper.
Figure 18:
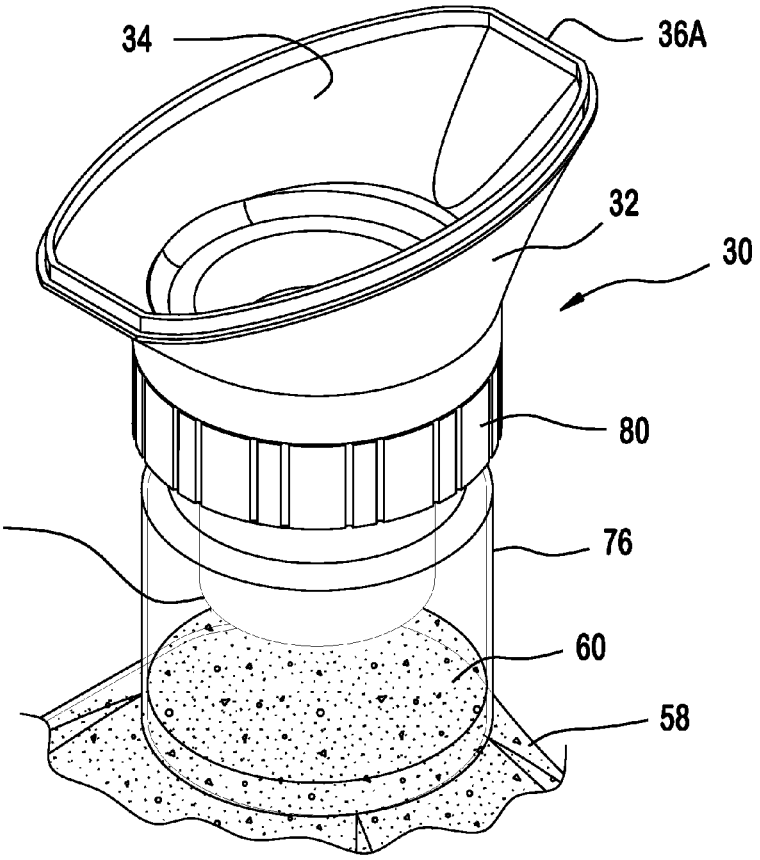
FIG. 18 is a second perspective of the dispenser of FIG. 15 showing the hopper rotated to allow flow of consumable fluid therein from the bottle.
Figure 19:
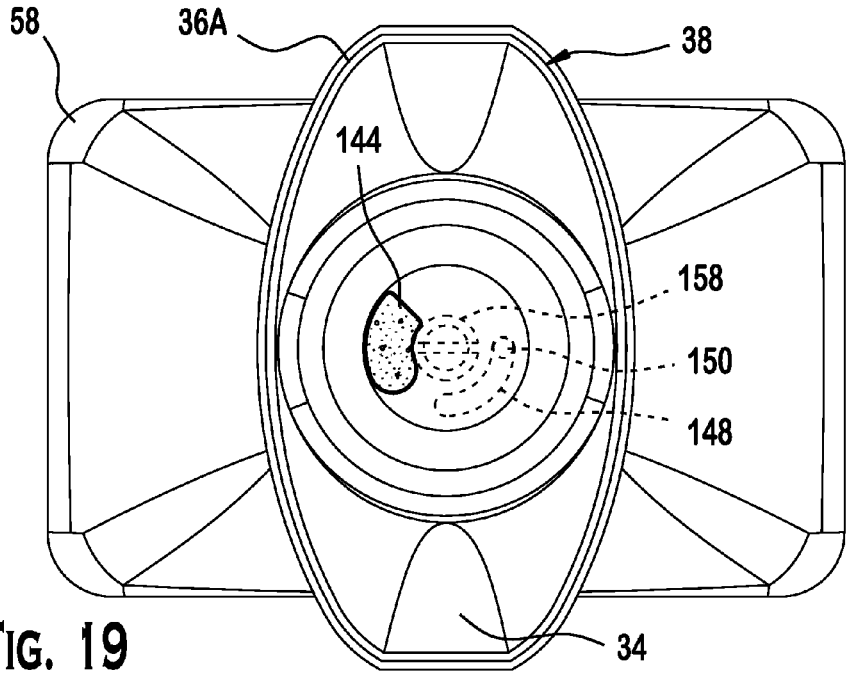
FIG. 19 is a top plan view of the dispenser of FIG. 18.
Figure 21:
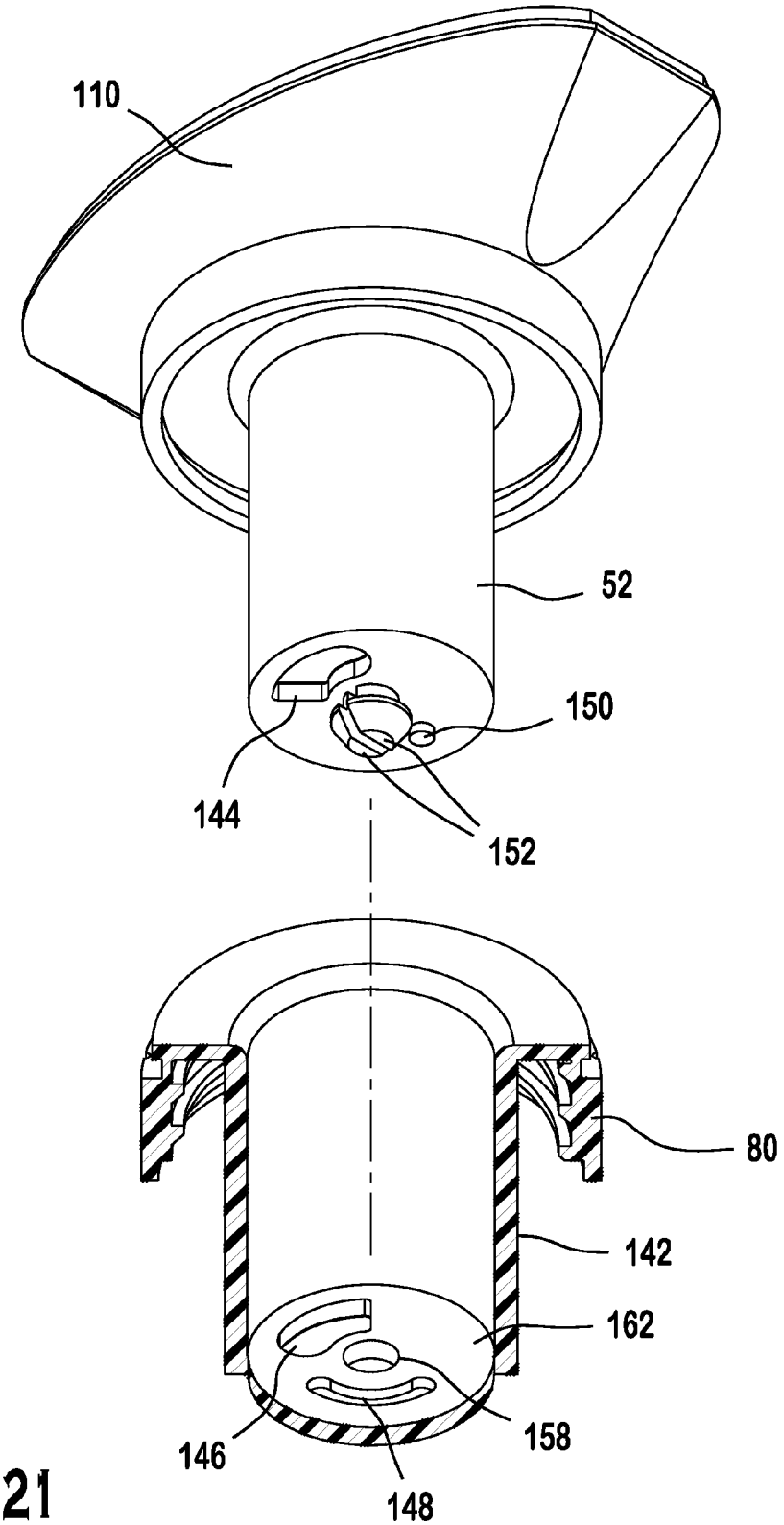
FIG. 21 is an exploded view of the hopper and collar of the dispenser of FIG. 15; The sheath of the collar preferably has a base that defines the second hole, a slot, and a bore; A pair of prongs may be located on the bottom of the hopper that are configured to engage the sheath bore; The prongs may be separated by a gap to allow the prongs to deform into closer proximity as the prongs beveled edges contact the edges of the sheath bore; This may result in the prongs moving together while the hopper is being inserted into the sheath and then snapping back into position once the hopper is fully inserted to form a rotatable connection between the hopper and the collar; A guide post can be located on the bottom of the hopper tube to engage the slot and guide the rotation of the hopper in the collar.

Referring to FIGS. 17 and 21, a collar 80 may be engaged with the dispenser body 32 and adapted to secure the dispenser 30 to a bottle 58. The collar can include a sheath 142 for receiving at least part of the hopper 34. The sheath 142 preferably defines a second hole 146 therethrough. The sheath can also define a bore 158 and the hopper may include a pair of prongs 152 adapted for insertion into the bore 158 to secure the hopper 34 to the sheath 142 while still allowing rotation therebetween. The gap 156 between the prongs 152 allows the prongs 152 to displace toward each other when their beveled edges 154 contact the edges of the bore 158 during insertion. Once inserted past the sheath 142, the prong 152 ends move outwardly to form a rotatable connection 122 between the hopper 34 and the collar 80.

Figure 16:
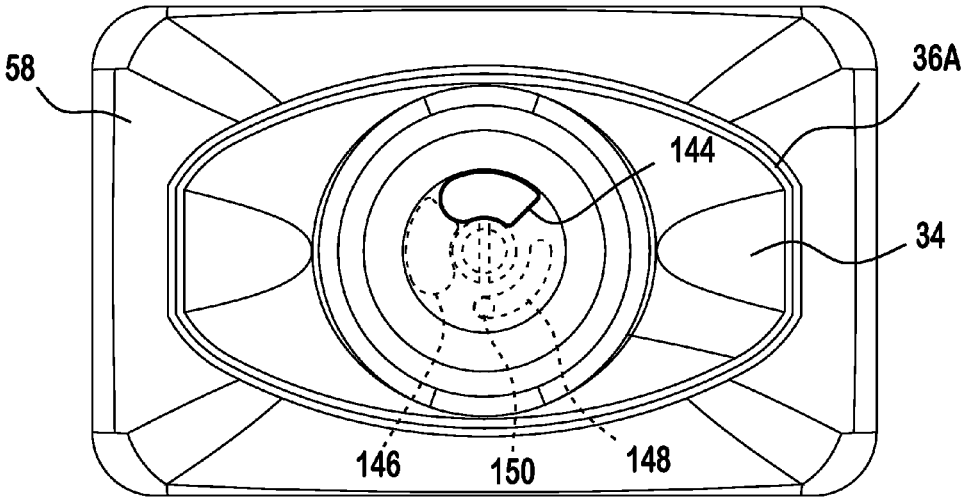
FIG. 16 is a top plan view of the dispenser of FIG. 15 with the lid removed; The hopper may define a first hole therethrough.
Figure 20:
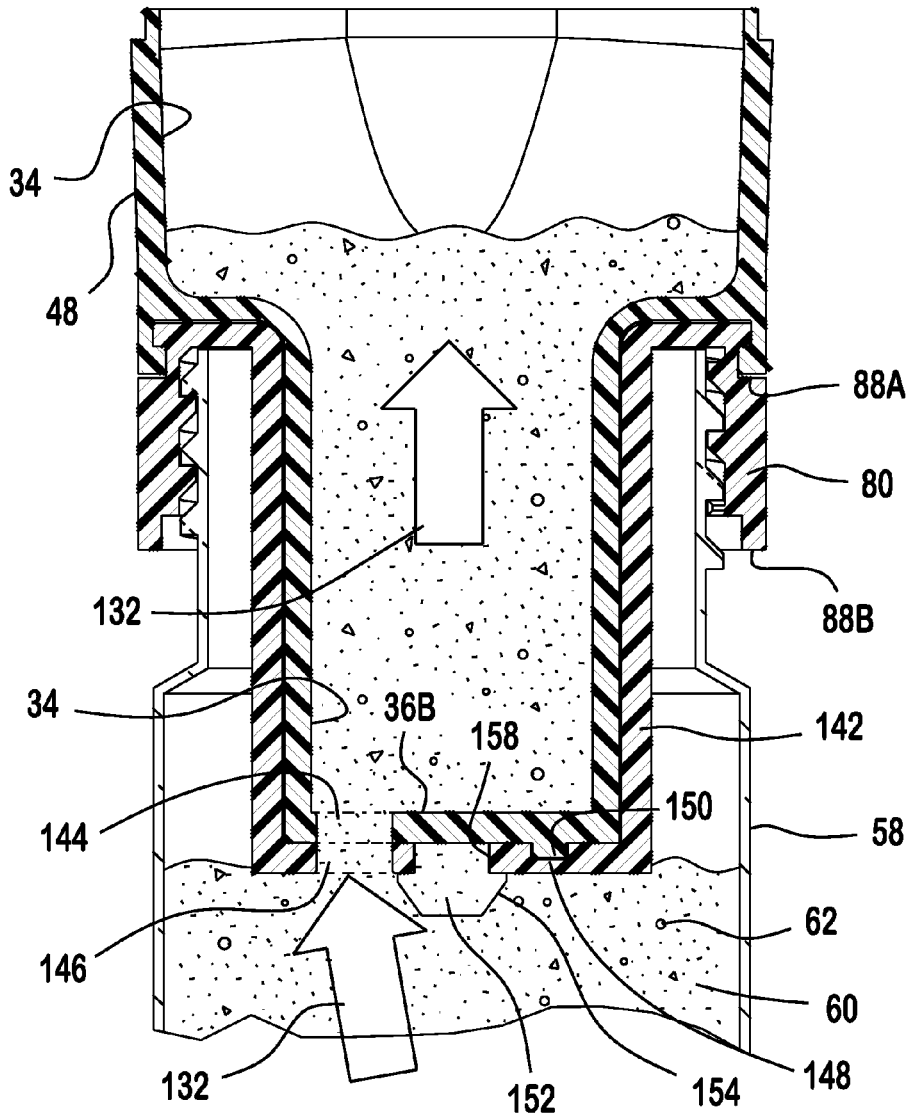
FIG. 20 is a partial cross section view of the dispenser of FIG. 18 showing the hopper preferably rotatably seated in the collar sheath; The collar sheath defining a second hole that is aligned with the hopper's first hole to allow consumable beverage to flow therebetween; The generally vertical arrows show the upwards flow of consumable fluid from the bottle into the hopper.

Referring to FIGS. 16 and 20, the first and second holes 144, 146 are preferably positioned to be generally perpendicular to a longitudinal axis 164 (shown in FIG. 23) of the bottle 58. The hopper 34 is preferably adapted to rotate generally about the longitudinal axis 164 of the bottle when the hopper 34 is moved between the first and second positions. A guide post 150 can be located on the hopper and may be adapted to engage a slot 148 defined by the sheath 142. The combination of the slot 148 and guide post 150 may be adapted to guide the rotation of the hopper 34.

It is preferred that the hopper 34 is moveable, relative to the collar 80, between a first hopper position (shown in FIGS. 16, 17, and 23), in which the first and second holes 144, 146 are not aligned and the salad dressing 60 cannot pass between the bottle 58 and the hopper 34, and a second hopper position (shown in FIGS. 19, 20, and 22), in which the first and second holes 144, 146 are aligned to allow salad dressing to pass between the bottle and the hopper wherein the dispenser is adapted to allow dispensing of the salad dressing 60 (or other consumable fluid) including the solid ingredients 62 in the predetermined amount from the hopper 34. In some embodiments, the dispenser may not be suitable for preventing the passage of alcoholic beverages therethrough from the hopper 34 back to the bottle 58 when the bottle is shaken.

Figure 22:
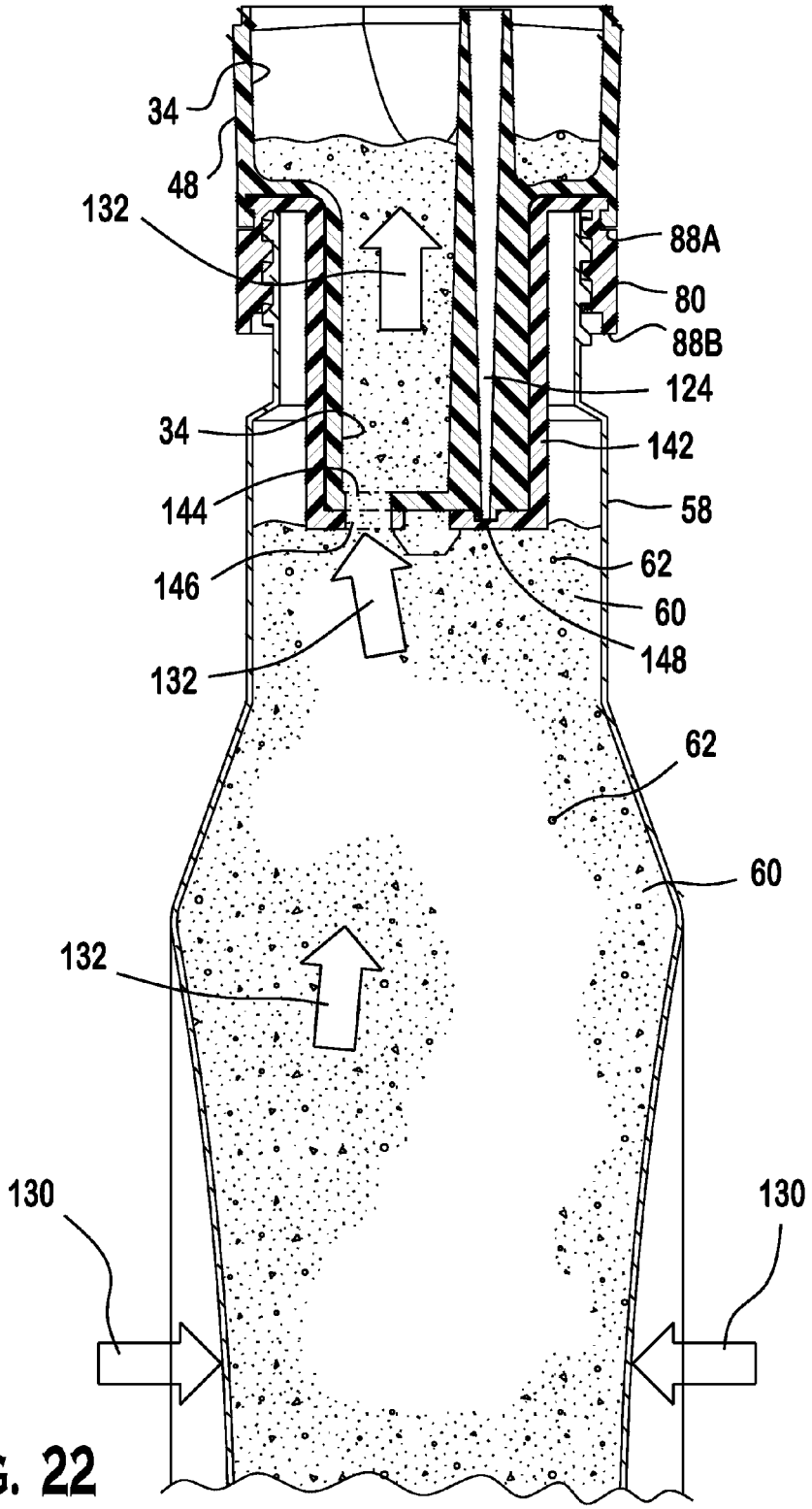
FIG. 22, is a radial cross-sectional view of a dispenser similar to that of FIG. 15 with a vent attached; Lateral arrows show force resulting from a squeeze action on the bottle and the generally vertical arrows show the flow of consumable fluid through the generally aligned first and second holes; During the expelling of consumable fluid from the bottle the check valve is positioned in a closed position with the base of the vent shaft sealed by a portion of the sheath to prevent airflow therethrough.
Figure 23:
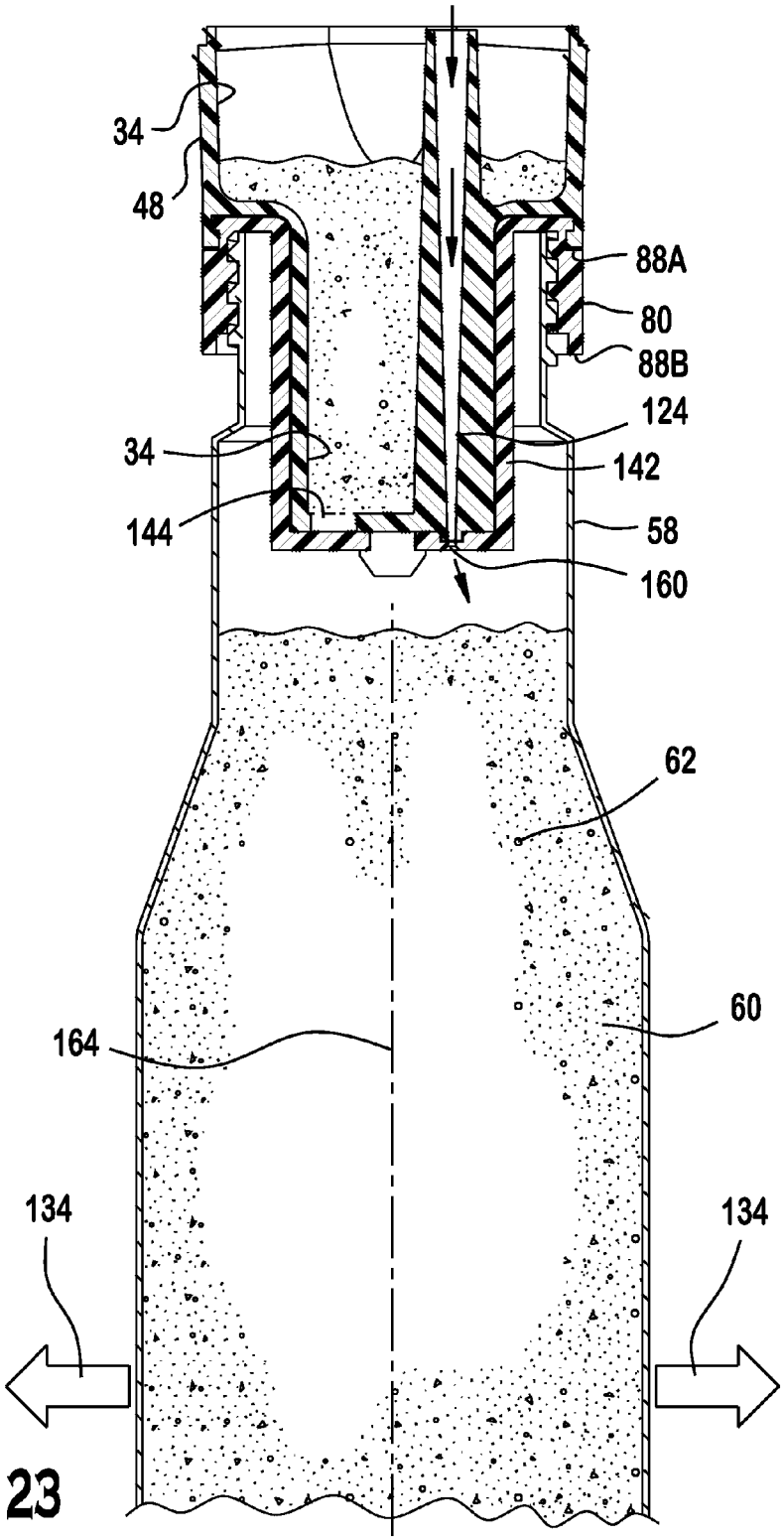
FIG. 23, is a radial cross-sectional view of a dispenser similar to that of FIG. 15 with a vent attached; Lateral arrows show force resulting from an expansion action on the bottle and the downwardly pointed vertical arrows show the flow of air into the bottle via the vent to help prevent backflow of consumable fluid into the bottle from the hopper; The first and second holes are not aligned to secure consumable fluid and any entrained solid ingredients in the hopper; During the expansion action, the intake of air is possible due to bottom of the vent being aligned with an air hole in the sheath.

Referring to FIGS. 22 and 23, a vent 124 may be included that is adapted to let air enter the bottle 58 when the hopper is in the first hopper position. Referring specifically to FIG. 22, lateral arrows 130 show force resulting from a squeeze action on the bottle 58 and the generally vertical arrows 132 show the flow of consumable fluid 60 through the generally aligned first and second holes 144, 146. During the expelling of consumable fluid 60 from the bottle the vent 124 is positioned in a closed position with the base of the vent shaft sealed by a portion of the sheath 142 to prevent airflow therethrough.

Referring specifically to FIG. 23, lateral arrows 134 show force resulting from an expansion action on the bottle 58 and the downwardly pointed vertical arrows 136 show the flow of air into the bottle 58 via the vent 124 to help prevent backflow of consumable fluid 60 into the bottle 58 from the hopper 34. The first and second holes 144, 146 are not aligned which then results in securing the consumable fluid 60 and any entrained solid ingredients 62 in the hopper 34. During the expansion action of the bottle, the intake of air is possible due to bottom of the vent 124 being aligned with an air hole 160 in the sheath 142.

It is recognized by those skilled in the art, that changes may be made to the above described embodiment of the invention without departing from the broad inventive concept thereof. For example, any of the connections between components of the dispenser described above can be interchanged with any one of a twist-lock connection, a friction fit, a snap fit, a ball and detent, an interlock, a magnetic connection, a threaded connection, or any other suitable connection without departing from the scope of the present invention. It is understood, therefore, that this invention is not limited to the particular embodiment disclosed, but is intended to cover to all modifications which are within the spirit and scope of the invention as defined by the appended claims and the drawings.

We claim:

1. A dispenser, comprising:

a dispenser body defining a hopper configured to hold a predetermined amount of salad dressing, the hopper defining a first hole therethrough;

a collar engaged with the dispenser body and configured to secure the dispenser to a bottle, the collar including a sheath for receiving at least part of the hopper circumferentially inside of the sheath, the sheath defining a second hole therethrough; and a vent provided in the hopper, wherein the hopper is moveable, relative to the collar, between a first hopper position, in which the first and second holes are not aligned and the salad dressing cannot pass between the bottle and the hopper, and a second hopper position, in which the first and second holes are aligned to allow the salad dressing to pass between the bottle and the hopper, wherein the dispenser is adapted to allow dispensing of the salad dressing including the solid ingredients in the predetermined amount from the hopper, and wherein the vent is configured to let air enter the bottle when the hopper is in the first hopper position.

2. The dispenser of claim 1, wherein the first and second holes are positioned to be generally perpendicular to a longitudinal axis of the bottle, and the hopper is configured to rotate generally about the longitudinal axis of the bottle when the hopper is moved between the first and second positions.

3. The dispenser of claim 2, wherein the sheath defines a bore, and the hopper includes a pair of prongs configured to be inserted into the bore to secure the hopper to the sheath while still allowing rotation therebetween.

4. The dispenser of claim 3, further comprising a guide post on the hopper configured to engage a slot defined by the sheath, wherein the combination of the slot and guide post are configured to guide the rotation of the hopper.

* * * * *